US011958710B2

(12) United States Patent
Taniguchi et al.

(10) Patent No.: US 11,958,710 B2
(45) Date of Patent: Apr. 16, 2024

(54) SHEET DETECTION DEVICE, PAPER DISCHARGE DEVICE, AND IMAGE FORMING APPARATUS

(71) Applicant: SHARP KABUSHIKI KAISHA, Sakai (JP)

(72) Inventors: Yuki Taniguchi, Sakai (JP); Tsuyoshi Shibayama, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 311 days.

(21) Appl. No.: 17/480,088

(22) Filed: Sep. 20, 2021

(65) Prior Publication Data

US 2022/0112042 A1 Apr. 14, 2022

(30) Foreign Application Priority Data

Oct. 13, 2020 (JP) ..... 2020-172758

(51) Int. Cl.

| | |
|---|---|
| ***B65H 43/08*** | (2006.01) |
| ***B65H 5/06*** | (2006.01) |
| ***B65H 29/12*** | (2006.01) |
| ***B65H 43/06*** | (2006.01) |

(52) U.S. Cl.

CPC ..... *B65H 43/08* (2013.01); *B65H 5/062* (2013.01); *B65H 29/12* (2013.01); *B65H 43/06* (2013.01); *B65H 2511/20* (2013.01); *B65H 2553/412* (2013.01); *B65H 2553/61* (2013.01)

(58) Field of Classification Search

CPC ..... B65H 29/12; B65H 29/125; B65H 29/14; B65H 43/00; B65H 43/06; B65H 43/08; B65H 2553/40; B65H 2553/41; B65H 2553/412; B65H 2553/60; B65H 2553/61; B65H 2553/81

See application file for complete search history.

(56) References Cited

U.S. PATENT DOCUMENTS

| | | | | |
|---|---|---|---|---|
| 2015/0307311 | A1* | 10/2015 | Ono | G03G 15/6552 271/176 |
| 2016/0272447 | A1* | 9/2016 | Koyama | B65H 5/062 |
| 2018/0339872 | A1* | 11/2018 | Mizuguchi | B65H 5/26 |
| 2021/0263460 | A1* | 8/2021 | Lin | G03G 15/553 |

FOREIGN PATENT DOCUMENTS

| | | | |
|---|---|---|---|
| JP | 2002-249278 | A | 9/2002 |

* cited by examiner

*Primary Examiner* — Prasad V Gokhale
(74) *Attorney, Agent, or Firm* — ScienBiziP, P.C.

(57) ABSTRACT

A sheet detection device includes, as detection pieces, a first detection piece integrally provided on a rotary shaft and a second detection piece attached to the first detection piece via a biasing member. The second detection piece is capable of rotation in conjunction with the first detection piece under a biasing force of the biasing member. When the second detection piece is brought into contact with a ceiling at an upper part of the rotary shaft, the second detection piece stops further rotation while the first detection piece is capable of rotation together with the rotary shaft against the biasing force.

9 Claims, 8 Drawing Sheets

SHEET DETECTION DEVICE, PAPER DISCHARGE DEVICE, AND IMAGE FORMING APPARATUS

BACKGROUND OF THE INVENTION

Field of the Invention

The present invention relates to a sheet detection device, a paper discharge device including the sheet detection device, and an image forming apparatus including the paper discharge device.

Description of the Background Art

Some image forming apparatuses include a sheet detection device that detects a sheet loading amount in a paper feed tray, a paper discharge tray or the like on which sheets such as recording paper are loaded, in order to prevent occurrence of loading defects or jams. As a sheet detection device of this kind, for example, Japanese Unexamined Patent Application Publication No. 2002-249278 discloses a configuration in which an actuator is provided on an upper surface of a sheet so that the actuator is always in contact therewith, and the position of the actuator is detected by a photo sensor so that a paper discharge operation is stopped when a height of the sheets loaded on the paper discharge tray exceeds a limit height, which is maximum load.

In the conventional sheet detection device described above, the actuator which rotates in contact with the sheet and a detection piece which crosses the photo sensor and shields an optical path are configured to rotate integrally, and rotation angles of the actuator and the detection piece are supposed to be equal. Therefore, if the angle of rotation of the actuator is to be secured, the detection piece must also rotate at a rotation angle corresponding to that, and a sufficiently large space for accommodating a movable area of the detection piece needs to be provided in the device.

In recent years, a request for size reduction of image forming apparatuses has been increasing more and more, and space-saving installation of various members constituting the image forming apparatus has been in demand. In view of such circumstances, it is not desirable to provide an extended installation space for the detection piece in the sheet detection device, but it is desirable to secure the movable areas for the actuator and a shutter without extending the installation space, whereby sheet detection is enabled in a saved space.

The present invention was made in consideration of the above-described problems, and an object thereof is to have a sheet detection device which enables sheet detection without increasing a size of the device by enabling space saving while securing a sufficient movable area for an actuator which swings in contact with a sheet and a detection piece which rotates in conjunction with the actuator and to provide a paper discharge device and an image forming apparatus including such sheet detection device.

SUMMARY OF THE INVENTION

In order to achieve the above-described object, in a sheet detection device including an actuator that is swingable in contact with a sheet, a rotary shaft that supports the actuator, capable of swing, and rotates with the actuator, a detection piece supported by the rotary shaft and rotatable therewith, and a detection sensor whose detection area overlaps a rotation trajectory of the detection piece, the detection piece includes a first detection piece integrally provided on the rotary shaft and a second detection piece attached to the first detection piece via a biasing member, the second detection piece is capable of rotation in conjunction with the first detection piece under a biasing force of the biasing member, and when the second detection piece is brought into contact with a ceiling disposed at an upper part of the rotary shaft, the second detection piece stops further rotation, while the first detection piece can rotate together with the rotary shaft against the biasing force.

As a more specific configuration in the sheet detection device, it is preferable that the first detection piece and the second detection piece are provided to face each other in an axial direction of the rotary shaft and that the first detection piece is provided within a projected area of the second detection piece in the axial direction.

In addition, in the sheet detection device of the above-described configuration, it is preferable that the first detection piece has a guide protrusion protruding toward the second detection piece, the second detection piece has a substantially arcuate guide groove around the rotary shaft, and the guide protrusion is provided to be capable of sliding in the guide groove.

Moreover, in the sheet detection device of the above-described configuration, it is preferable that the second detection piece is provided to be rotatable with respect to the rotary shaft, and the biasing member biases the second detection piece upward in a direction of rotation around the rotary shaft with respect to the first detection piece.

By providing these specified matters, even if the rotation angle of the second detection piece is reduced, the first detection piece is further rotated with respect to the second detection piece, whereby the rotation angle of the actuator can be ensured large, and space can be saved.

In addition, a paper discharge device including the sheet detection device according to each of the above-mentioned solutions is also within the scope of the technical idea of the present invention. That is, the actuator of the sheet detection device is brought into contact with a sheet passing through a sheet discharge port, and swings between a standby posture crossing the sheet discharge port and an open posture opening the sheet discharge port, and a paper discharge tray in which a sheet having passed through the sheet discharge port is loaded is provided below the actuator, and in the standby posture, a tip of the actuator is brought into contact with the uppermost sheet on the paper discharge tray.

An image forming apparatus including the above-mentioned paper discharge device is also within the scope of the technical idea of the present invention and enables sheet detection in a space-saving manner without causing the size increase of the apparatus.

In the present invention, the first detection piece and the second detection piece are provided as the detection pieces, and the first detection piece is configured to rotate around the rotary shaft, so that space can be saved, while securing a sufficient movable area for the actuator which swings in contact with the sheet and the detection piece which rotates in conjunction with the actuator, and the sheet detection can be performed without increasing the size of the device.

DESCRIPTION OF THE PREFERRED EMBODIMENTS

An image forming apparatus 1, a sheet detection device 10 and a paper discharge device 15 provided in the image forming apparatus 1 according to an embodiment of the present invention will be described below with reference to the drawings.

Image Forming Apparatus

Figure 1:
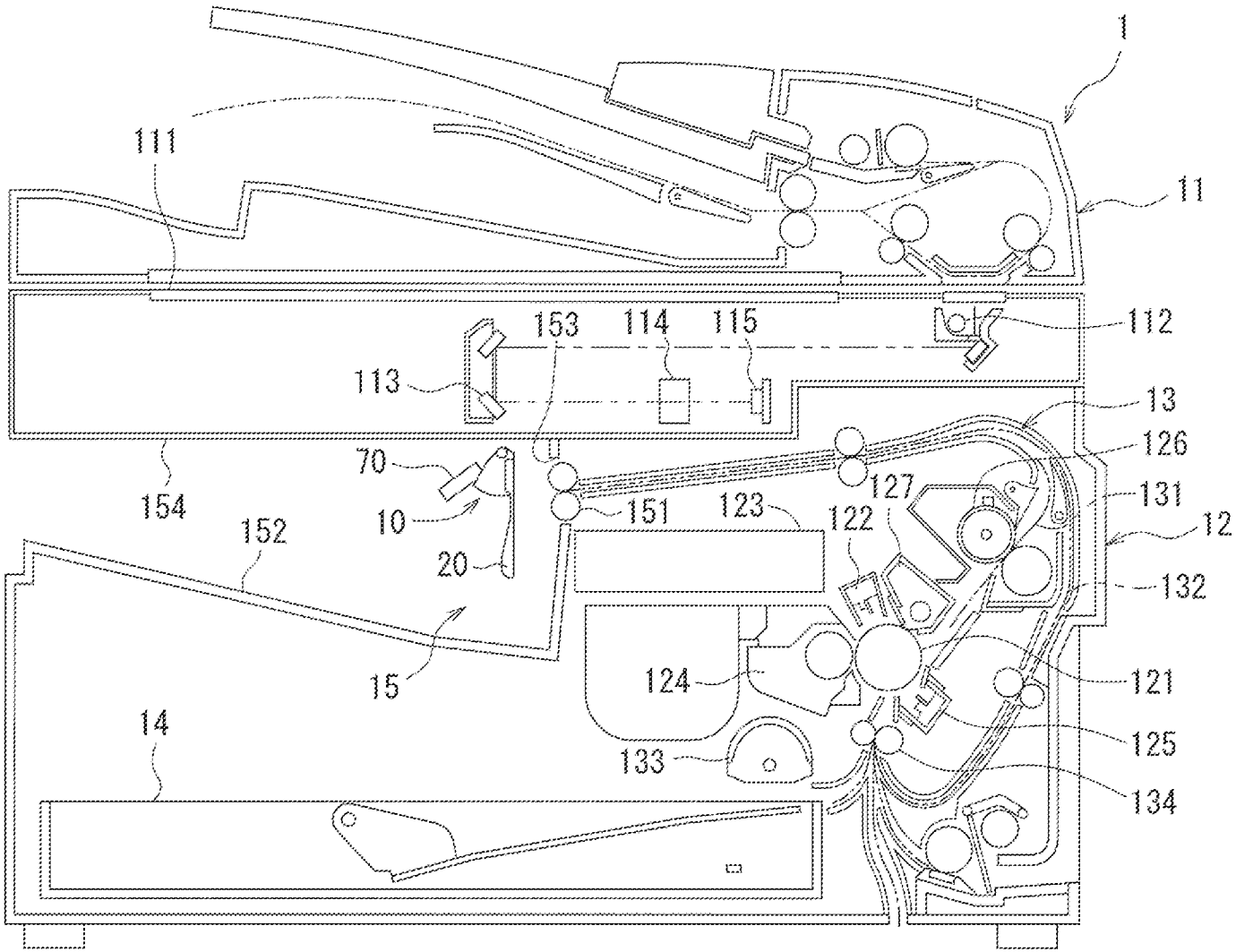
FIG. 1 is an explanatory diagram illustrating a schematic configuration of an image forming apparatus according to an embodiment of the present invention.

FIG. 1 is an explanatory diagram illustrating a schematic configuration of the image forming apparatus 1 according to the embodiment of the present invention. The image forming apparatus 1 includes a manuscript reader 11, an image former 12, a sheet conveyer 13, and a sheet discharger (paper discharge device 15).

The manuscript reader 11 emits light onto a manuscript and generates image data corresponding to an image of the manuscript from the reflected light thereof. The image former 12 forms a visible image on the basis of the image data generated by the manuscript reader 11 and prints this visible image on a sheet such as a predetermined recording paper. The sheet conveyer 13 supplies sheets to the image former 12 and discharges the image formed sheets to a paper discharge tray 152.

The manuscript reader 11 has a manuscript table 111 on which a transparent glass is disposed. A scanner optical system is disposed below the manuscript table 111. This scanner optical system includes an exposure lamp 112, a reflecting mirror 113, an imaging lens 114, and a photoelectric conversion device (CCD) 115. The exposure lamp 112 is a light source for emitting light onto the manuscript placed on the manuscript table 111. The reflecting mirror 113 leads the reflected light from the manuscript to the imaging lens 114 and the CCD 115 as indicated by two-dotted lines in the figure, for example. The CCD 115 receives the reflected light imaged by the imaging lens 114 and generates an electrical signal corresponding to this reflected light as an image signal.

The image former 12 includes a photoconductor drum 121, a charger 122, an exposurer (LSU) 123, a developer 124, a transferrer 125, a fixer 126, and a cleaner 127. The photoconductor drum 121 has a photosensitive layer formed on its surface. The charger 122 charges the surface of the photoconductor drum 121 to a predetermined potential. The exposurer 123 forms an electrostatic latent image corresponding to the image signal of the manuscript by causing a laser beam to scan and to expose the surface of the charged photoconductor drum 121. The developer 124 develops the electrostatic latent image formed on the surface of the photoconductor drum 121 with toner and forms a toner image. The transferrer 125 transfers the toner image on the photoconductor drum 121 to a sheet. The fixer 126 has a pair of rollers and fixes the toner image by heating and pressurizing the sheet with an unfixed toner image having been transferred that passes between nips of the pair of rollers. The cleaner 127 removes the toner remaining on the surface of the photoconductor drum 121 after the toner image has been transferred to the sheet.

The sheet conveyer 13 includes a main conveying path 131, a sub conveying path 132, a pickup roller 133, a resist roller 134, and a conveying roller and the like. The main conveying path 131 is a conveying path through which the sheet passes, and the resist roller 134, the transferrer 125, and the fixer 126 are disposed along the main conveying path 131. The sub conveying path 132 is a conveying path for switching back the sheet whose surface has been printed and leading it to an upstream side of the resist roller 134 of the main conveying path 131 when double-sided printing is performed.

A paper feed cassette 14 accommodates a sheet before image formation. The pickup roller 133 is a roller for feeding one sheet at a time from the paper feed cassette 14. The resist roller 134 holds the sheet once it has been conveyed through the main conveying path 131, and then conveys it with a tip of the sheet in line with the toner image on the photoconductor drum 121.

The sheet on which the toner image has been transferred is conveyed through the fixer 126 and a paper discharge roller 151 to the paper discharge device 15 of the sheet discharger. The paper discharge roller 151 is provided in the vicinity of a sheet discharge port 153. The paper discharge roller 151 also has a function as a rear-surface printing mechanism together with the sub conveying path 132.

Paper Discharge Device and Sheet Detection Device

The sheet discharger of the image forming apparatus 1 includes the paper discharge device 15 that loads and accommodates sheets such as recording paper that have been conveyed. This embodiment describes a case in which the sheet detection device 10 is provided in the paper discharge device 15 in the image forming apparatus 1.

As shown in FIG. 1, the paper discharge device 15 includes the sheet discharge port 153, the paper discharge tray 152, and the sheet detection device 10. A ceiling 154 is disposed above the sheet discharge port 153 to cover a space for paper discharge. The sheet detection device 10 is provided at an upper part of the paper discharge tray 152 and near the sheet discharge port 153. The sheets discharged from the sheet discharge port 153 are loaded onto the paper discharge tray 152. In this case, the sheet detection device 10 is configured to detect a loading height of the sheets on the paper discharge tray 152 and to detect that a maximum number of sheets have been loaded at a predetermined height (full state).

Figure 2:
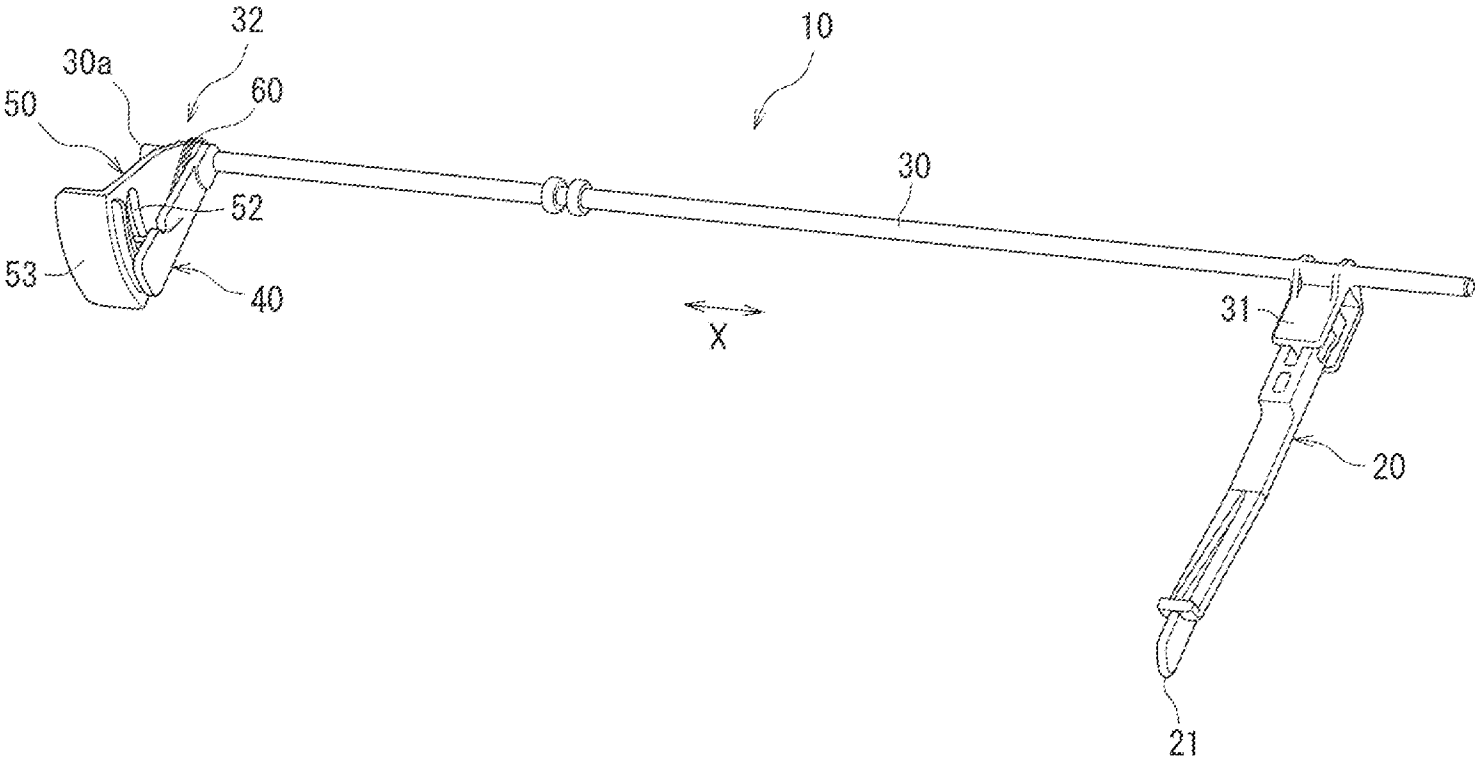
FIG. 2 is a perspective view illustrating a sheet detection device according to the embodiment of the present invention.
Figure 3:
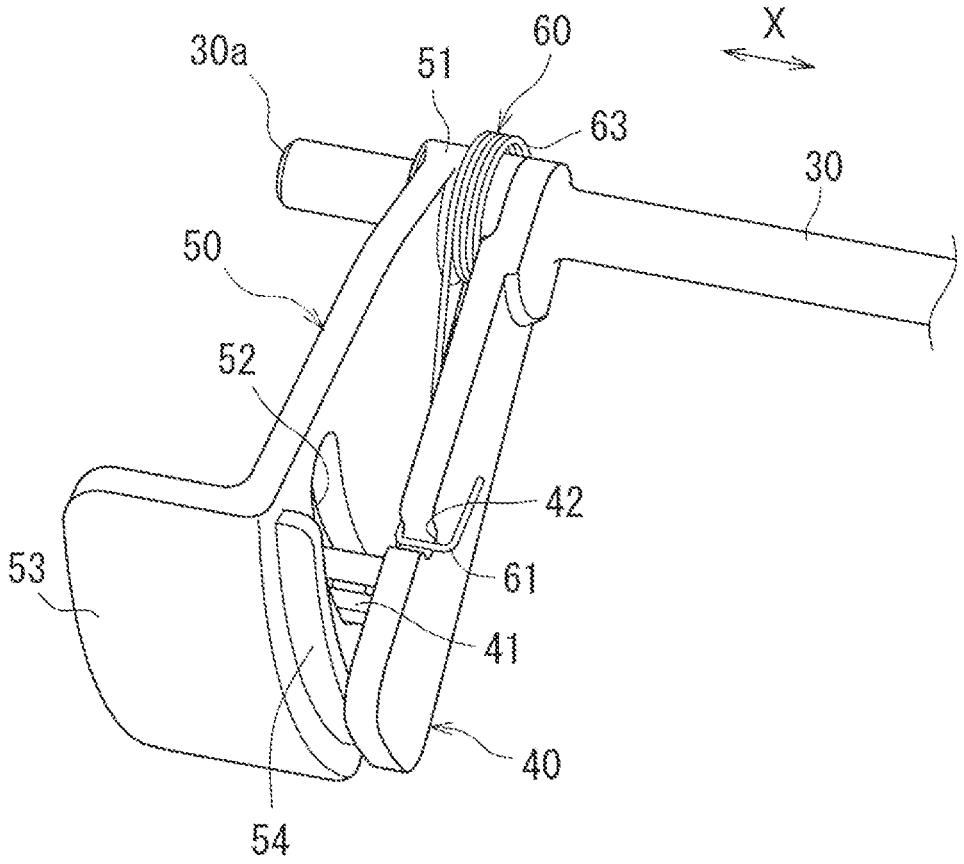
FIG. 3 is a perspective view illustrating a detection piece in the sheet detection device in an enlarged manner.
Figure 4:
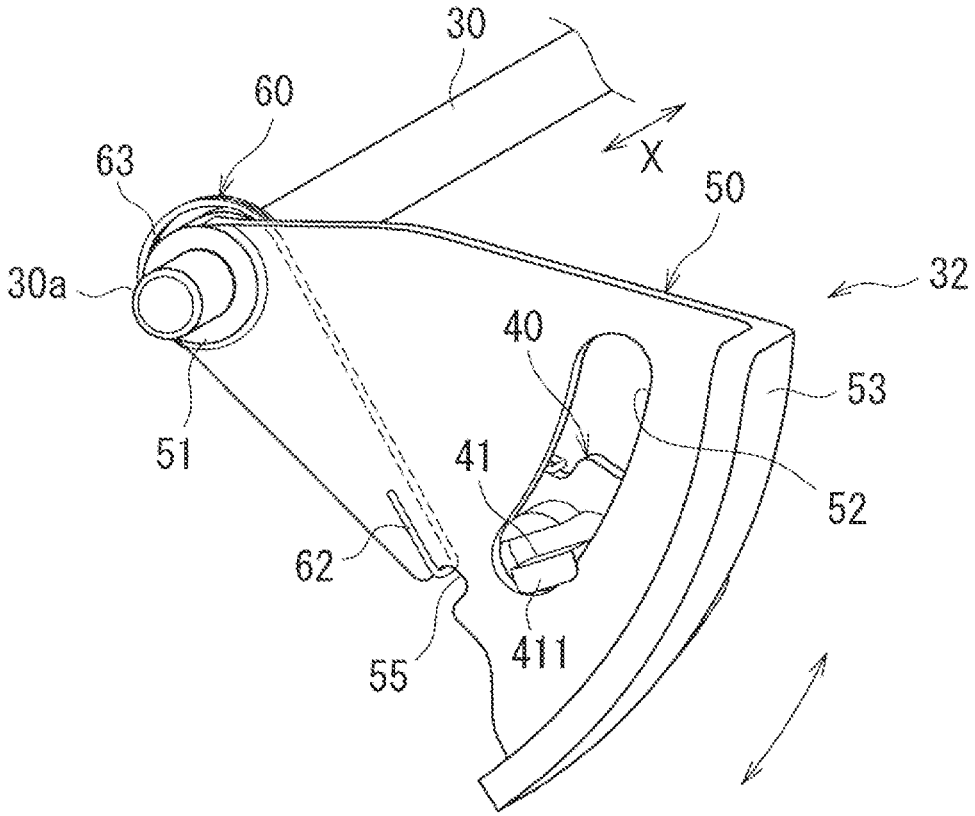
FIG. 4 is a perspective view illustrating the detection piece in the sheet detection device in an enlarged manner.
Figure 5:
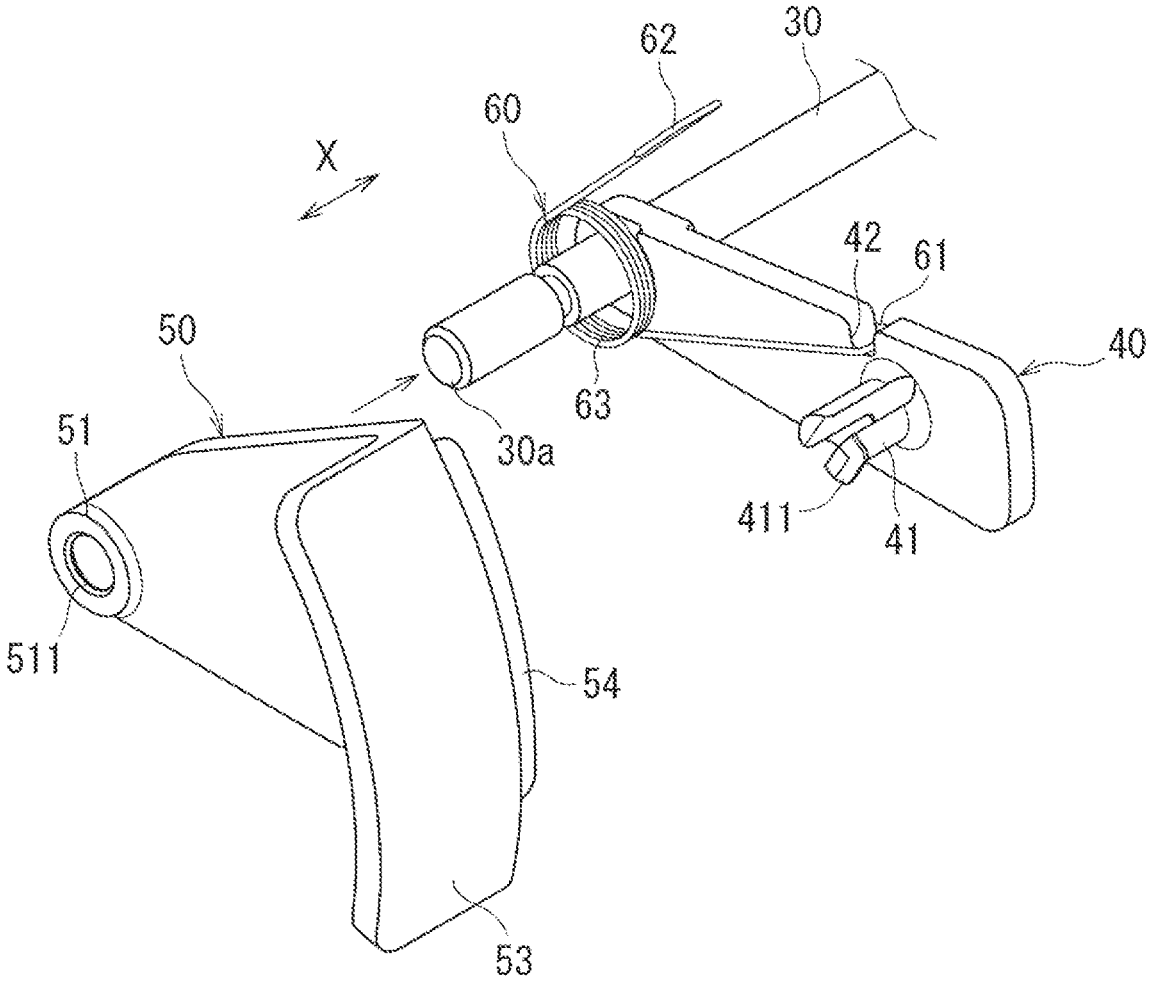
FIG. 5 is an exploded perspective view illustrating the sheet detection piece.

FIG. 2 is a perspective view illustrating the sheet detection device 10 according to this embodiment. FIGS. 3 and 4 are perspective views of the first detection piece 40 and the second detection piece 50 in the sheet detection device 10 in an enlarged manner, and FIG. 5 is an exploded perspective view of the first detection piece 40 and the second detection piece 50. FIGS. 6 to 9 are explanatory diagrams illustrating movement of an actuator 20 in the sheet detection device 10, respectively.

As shown in FIG. 2, the sheet detection device 10 in the exemplified form has the actuator 20, a rotary shaft 30 supporting the actuator 20, and a detection piece 32 provided on the rotary shaft 30. The rotary shaft 30 is disposed above the sheet discharge port 153 and is rotatably supported. An axial direction X of the rotary shaft 30 is a direction orthogonal to a discharge direction of the sheet from the sheet discharge port 153 and in parallel to a width direction of the sheet, for example.

The actuator 20 is supported by the rotary shaft 30 and is provided capable of swing around the axis of the rotary shaft 30. A holder 31 of the actuator 20 is integrally formed near one end of the rotary shaft 30 in the axial direction X. The actuator 20 is mounted on and fixed to the holder 31, and a tip 21 is extended in a direction away from the rotary shaft 30. As a result, the actuator 20 is provided to be brought into contact with the sheet passing through the sheet discharge port 153 and thereby to swing around the rotary shaft 30. The rotary shaft 30 freely rotates around the axis in conjunction with the swing of the actuator 20.

The detection piece 32 is provided near the other end 30*a* in the axial direction X of the rotary shaft 30. The detection piece 32 is extended from the rotary shaft 30 in a radial direction orthogonal to the axial direction X of the rotary shaft 30, and is rotatable together with the rotary shaft 30. In the exemplified form, the detection piece 32 has the first detection piece 40 integrally provided with the rotary shaft 30 and the second detection piece 50 separate from the first detection piece 40. A biasing member 60 is disposed between the first detection piece 40 and the second detection piece 50.

As shown in FIG. 3 in the enlarged manner, the first detection piece 40 and the second detection piece 50 are disposed so as to face each other in the axial direction X of the rotary shaft 30. The first detection piece 40 is integrally formed on the rotary shaft 30 and is a strip-like member extending in the radial direction from the rotary shaft 30.

As shown in FIG. 1, the first detection piece 40 is provided with a length extended from the rotary shaft 30 shorter than the length of the actuator 20. In addition, as shown in FIG. 5, the first detection piece 40 has a guide protrusion 41 protruding toward the second detection piece 50 along the axial direction X. The guide protrusion 41 includes a claw 411 protruding outwardly in the radial direction at the tip.

The second detection piece 50 is provided on the end 30*a* side of the rotary shaft 30 with the biasing member 60 interposed between itself and the first detection piece 40. As shown in FIG. 4, the second detection piece 50 has a substantially fan-shaped outline around the rotary shaft 30. The first detection piece 40 is provided with a size that fits within the projected area of the second detection piece 50 in the axial direction X.

In the second detection piece 50, a guide groove 52 with a predetermined width is formed near the outer side in the radial direction. The guide groove 52 is a long hole penetrating through the front and rear of the second detection piece 50, and has a substantially arcuate shape as a whole. A guide protrusion 41 of the first detection piece 40 is disposed in the guide groove 52. The claw 411 of the guide protrusion 41 is locked in the outer edge of the guide groove 52. As a result, the guide protrusion 41 can slide along the guide groove 52 without falling out of the guide groove 52.

In addition, as shown in FIG. 5, the second detection piece 50 has a support 51 that is mounted on the rotary shaft 30, and a shaft hole 511 is provided in the support 51. The end 30*a* of the rotary shaft 30 is inserted into the shaft hole 511. The second detection piece 50 is mounted on the rotary shaft 30 via the support 51 and is provided to be rotatable with respect to the rotary shaft 30. In a state where no external force acts on the second detection piece 50, the second detection piece 50 hangs down below the rotary shaft 30 by its own weight.

A biasing member 60 is disposed between the first detection piece 40 and the second detection piece 50. As the biasing member 60, a kick spring is provided in the illustrated form. As shown in FIG. 5, the kick spring as the biasing member 60 has a coil 63 externally attached to the rotary shaft 30, and a first hook 61 and a second hook 62 as locking portions extending from the coil 63, respectively.

As shown in FIG. 3, the first hook 61 of the biasing member 60 is engaged with a first locking portion 42 provided having a recessed shape in an upper edge of the first detection piece 40. The coil 63 is attached to an outer circumference of the support 51 of the second detection piece 50 mounted on the rotary shaft 30. As shown in FIG. 4, the second hook 62 of the biasing member 60 is engaged with a second locking portion 55 having a recessed shape and provided in a lower edge of the second detection piece 50.

As a result, the biasing member 60 is disposed in a contracted state between the first detection piece 40 and the second detection piece 50, and holds the second detection piece 50 in a state of being biased upward in a direction of rotation around the rotary shaft 30 with respect to the first detection piece 40. The second detection piece 50 is brought into a state attached to the first detection piece 40 integral with the rotary shaft 30 under the biasing force of the biasing member 60, and can be rotated around the rotary shaft 30 in conjunction with the first detection piece 40. The first detection piece 40 and the second detection piece 50 are disposed so that they overlap in the axial direction X.

The second detection piece 50 includes a spacer protrusion 54 protruding toward the first detection piece 40 side so that the second detection piece 50 can maintain an arrangement form facing the first detection piece 40 even by rotation. As shown in FIG. 3, the spacer protrusion 54 is provided closer to the outer side in the radial direction than the guide groove 52. The spacer protrusion 54 is formed with a certain protruding amount (a protruding amount corresponding to a width in the axial direction X in the biasing member 60, for example) and has a substantially arcuate outer shape. A surface in the first detection piece 40 facing the second detection piece 50 rotates while in contact with the spacer protrusion 54, thereby maintaining a constant interval between the first detection piece 40 and the second detection piece 50.

Figure 6:
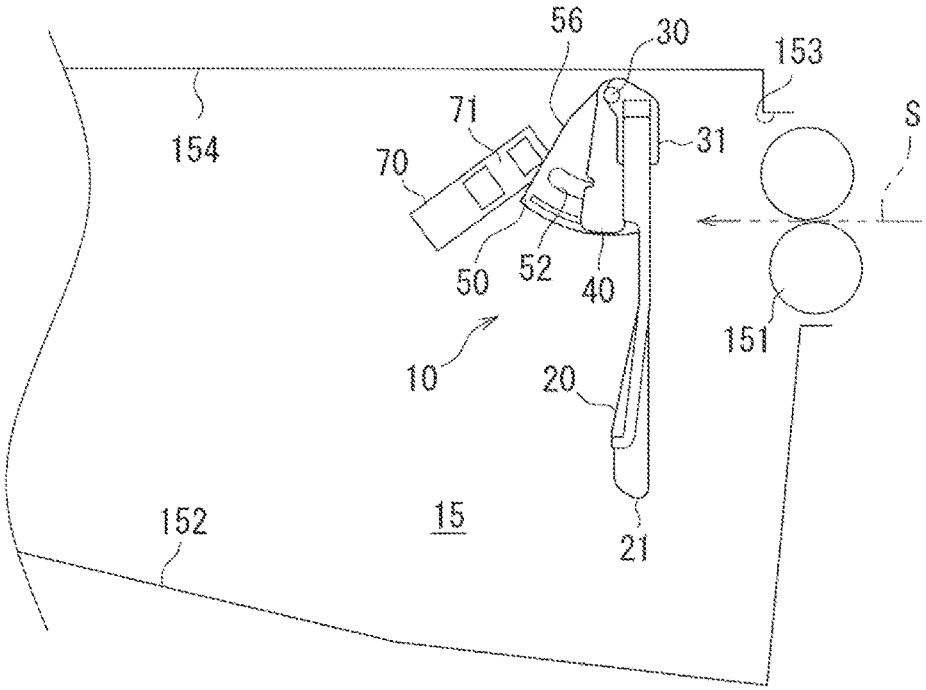
FIG. 6 is an explanatory diagram illustrating a standby posture of an actuator in the sheet detection device.

As shown in FIG. 1, the sheet detection device 10 includes a detection sensor 70. The detection sensor 70 is disposed on the end 30*a* side of the rotary shaft 30, adjacent to the second detection piece 50. As shown in FIG. 6, the detection sensor 70 is provided, for example, on an inner wall surface of the paper discharge device 15, on a downstream side of the sheet discharge direction S than the rotary shaft 30.

In the illustrated form, the detection sensor 70 is a photo sensor having a light emitter and a light receiver facing each other at a predetermined interval, and an optical path from the light emitter to the light receiver is formed in a detection area 71. In the detection area 71, when the optical path is shielded or opened, the detection sensor 70 is switched ON/OFF and outputs a signal. In this case, the detection sensor 70 is disposed so that a rotation trajectory of a shield 53 of the second detection piece 50 overlaps the detection area 71 of the detection sensor 70.

As shown in FIG. 6, when the actuator 20 is in the standby posture in which the actuator 20 hangs down from the rotary shaft 30 and positioned in the direction crossing the sheet discharge port 153, the first detection piece 40 also rests in the same hanging-down state as the actuator 20. The second detection piece 50, which is interlocked with the first detection piece 40, overlaps the first detection piece 40 and rests without reaching the detection area 71 of the detection sensor 70. In other words, the detection sensor 70 outputs a signal indicating OFF.

Figure 7:
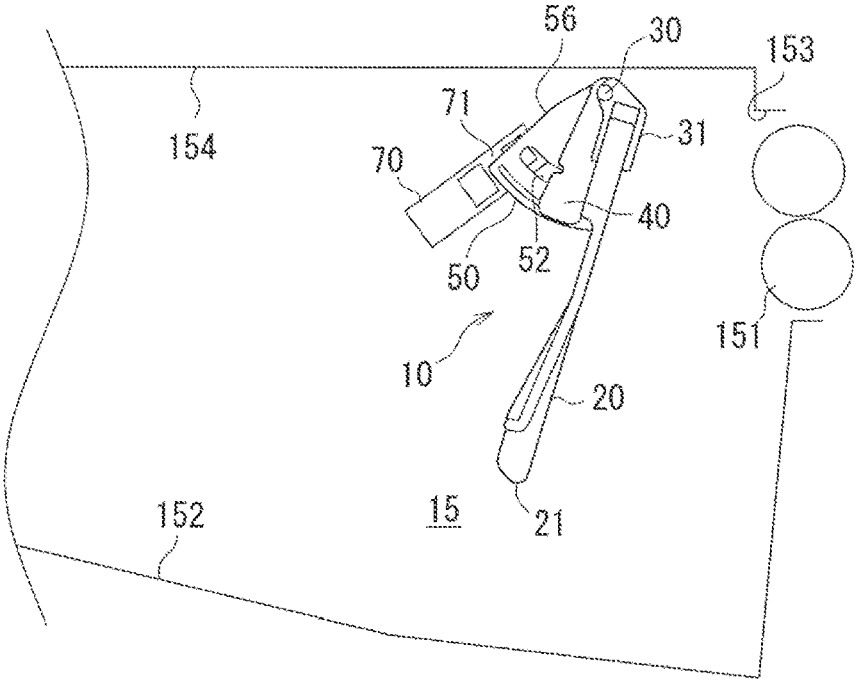
FIG. 7 is an explanatory diagram illustrating movement of the actuator in the sheet detection device.
Figure 8:
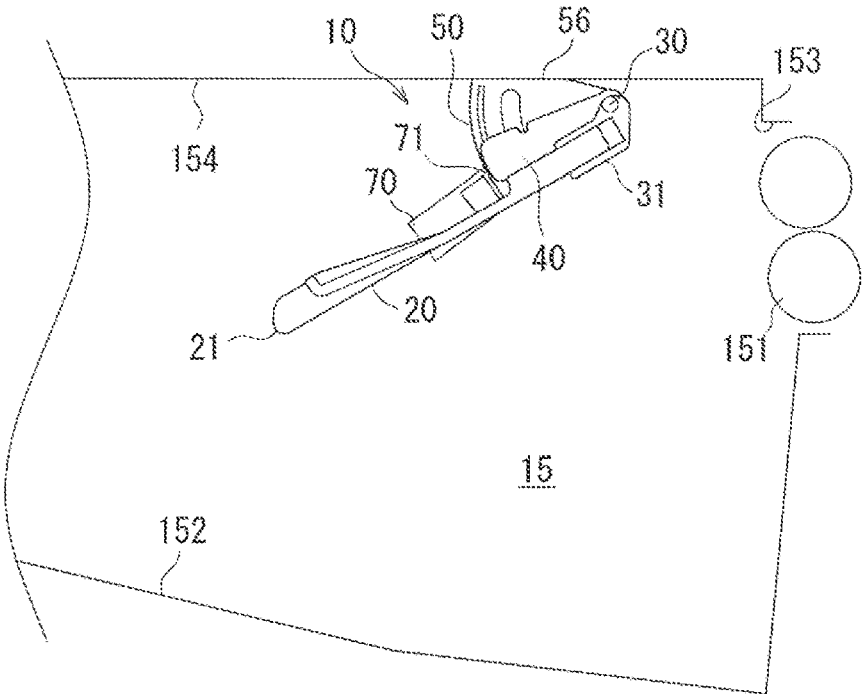
FIG. 8 is an explanatory diagram illustrating the movement of the actuator in the sheet detection device and illustrating a state in which a second detection piece is in contact with a ceiling.

The image-formed sheet is discharged from the sheet discharge port 153 via the paper discharge roller 151 in the sheet discharge direction S. At this time, the actuator 20 is in contact with the sheet and swings around the rotary shaft 30. As shown in FIGS. 7 and 8, when the actuator 20 swings, the rotary shaft 30 supporting the actuator 20 is rotated, and in conjunction therewith the first detection piece 40 and the second detection piece 50, which is biased upward in the rotating direction with respect to the first detection piece 40, both rotate. The shield 53 (see FIG. 3 and the like) of the second detection piece 50 reaches the detection area 71 of the detection sensor 70 and shields the optical path. The detection sensor 70 outputs a signal indicating ON.

Figure 9:
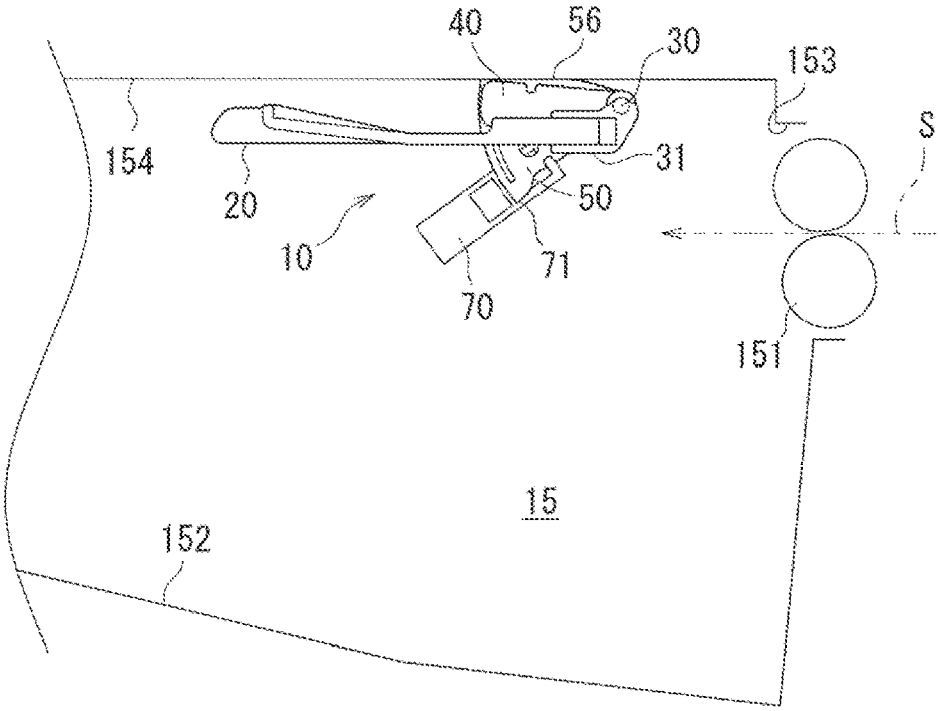
FIG. 9 is an explanatory diagram illustrating an open posture of the actuator in the sheet detection device.

When a sheet is discharged, as shown in FIG. 9, the actuator 20 comes into contact with the sheet being conveyed in the sheet discharge direction S, and the actuator 20 rotates to a position above the sheet passing through the sheet discharge port 153 and then, enters an open posture to open the sheet discharge port 153. With the actuator 20 in the open posture, the first detection piece 40 and the second detection piece 50 rotate around the rotary shaft 30, and an upper edge 56 of the second detection piece 50 is brought into contact with the ceiling 154 disposed at the upper part of the sheet discharge port 153.

The second detection piece 50 becomes unable to rotate as the upper edge 56 is brought into contact with the ceiling 154, and further rotation is stopped. In contrast, the first detection piece 40 continues to rotate by following the actuator 20 against the biasing force of the biasing member 60. At this time, as shown in FIG. 4, the first detection piece 40 rotates against the biasing force of the biasing member 60 while the guide protrusion 41 slides through the guide groove 52 of the second detection piece 50 from the lower end to the upper end and takes a reaction force against the second detection piece 50 which is in contact with the ceiling 154.

The second detection piece 50 is disposed overlapping the detection area 71 of the detection sensor 70 and shielding the optical path, and the detection sensor 70 outputs a signal indicating ON. When the sheet is completely discharged and falls on the paper discharge tray 152, the actuator 20 hangs down by its own weight and returns to the standby posture shown in FIG. 6. The time during which the optical path in the detection sensor 70 is shielded is not more than a certain time (discharge time of one sheet, for example).

As the image-formed sheet is discharged from the sheet discharge port 153 and loaded onto the paper discharge tray 152, the tip 21 of the actuator 20 eventually comes into contact with the loaded sheet. When the uppermost sheet of the loaded sheet bundle is brought into contact with the tip 21 of the actuator 20, as shown in FIG. 7, for example, the actuator 20 stops at the detection position of the contacted sheet. The second detection piece 50 overlaps the detection area 71 of the detection sensor 70 and stops rotating in a state where the optical path is shielded. The detection sensor 70 is switched from OFF to ON.

As sheets are further loaded on the paper discharge tray 152, the actuator 20 is pushed up and rotated, as shown in FIG. 8, so that the second detection piece 50 has its upper edge 56 brought into contact with the ceiling 154. Until the second detection piece 50 is brought into contact with the ceiling 154, the second detection piece 50 and the first detection piece 40 rotate integrally, and the guide protrusion 41 of the first detection piece 40 is located at the lower end of the guide groove 52 (on the downstream side in a clockwise direction in FIG. 4).

Although the rotation of the second detection piece 50 is stopped by the contact of the second detection piece 50 with the ceiling 154, an increase in the height of the sheet bundle loaded on the paper discharge tray 152 causes the actuator 20, whose tip 21 is brought into contact with the uppermost sheet of the sheet bundle, to rotate further. The first detection piece 40 is capable of rotating against the biasing force, and further rotation of the actuator 20 is allowed. Therefore, as shown in FIG. 8, even if the second detection piece 50 is brought into contact with the ceiling 154, the actuator 20 can be further rotated in that state, and the sheet can be continuously discharged.

As the sheet is further discharged, the actuator 20 is rotated to an open posture where it becomes substantially horizontal, as shown in FIG. 9. The first detection piece 40 is further rotated with respect to the second detection piece 50 which is in contact with the ceiling 154. When the guide protrusion 41 of the first detection piece 40 reaches the upper end of the guide groove 52 of the second detection piece 50, the rotation of the first detection piece 40 also stops. The shield 53 of the second detection piece 50 overlaps the detection area 71 of the detection sensor 70 so as to completely shield the optical path, and since the shielding time is longer than a certain time, it is detected that the maximum number of sheets have been loaded (full state).

When the full state is detected, a message indicating that the sheets are in the full state is displayed on an operation panel, for example, of the image forming apparatus 1 or the image forming operation is stopped. When the loaded sheet bundle is removed from the paper discharge tray 152, the actuator 20 returns to the standby posture shown in FIG. 6, and the first detection piece 40 and the second detection piece 50 also rotate to their original states.

As described above, in the sheet detection device 10, the movable area of the actuator 20, which swings in contact with the sheet, is the area from the standby posture shown in FIG. 6 to the open posture shown in FIG. 9. In contrast, the first detection piece 40 and the second detection piece 50 are provided so as to overlap in the axial direction X, and the rotation of the second detection piece 50 and the rotation of the first detection piece 40 relative to the second detection piece 50 can correspond to the movable area of the actuator 20. Therefore, the sizes of the first detection piece 40 and the second detection piece 50, and in particular the projected area of the second detection piece 50 in the axial direction X, can be suppressed, whereby the sheet detection device 10 can be installed in a space-saving manner.

Figure 10:
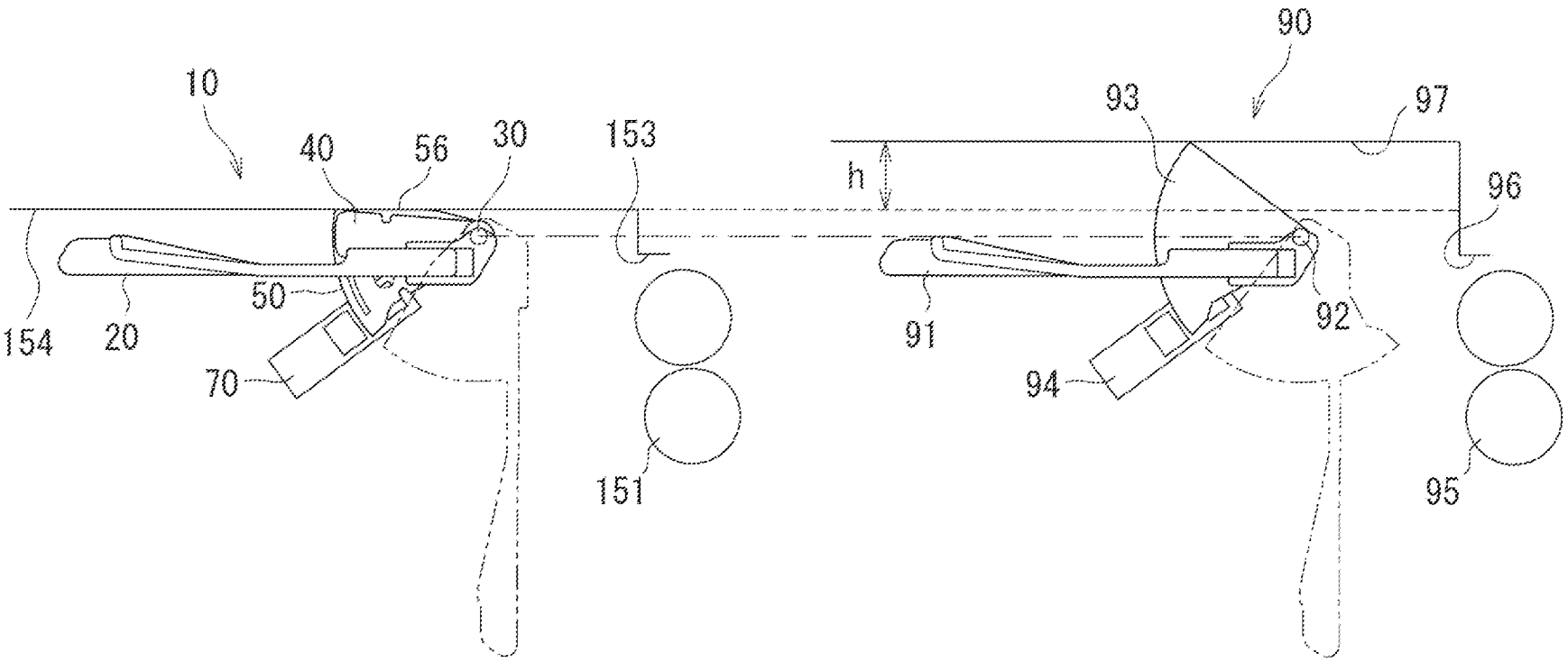
FIG. 10 is an illustration showing a comparison of the arrangement form between the sheet detection device of this embodiment and a conventional type detection device.

FIG. 10 is an explanatory diagram illustrating comparison in the arrangement form between the sheet detection device 10 of this embodiment and a detection device 90 as a conventional example. As shown in the figure, the conventional detection device 90 has an actuator 91 and a detection piece 93 provided rotatably around a rotary shaft 92 with respect to a sheet discharged from a paper discharge port 96 including a paper discharge roller 95. The detection piece 93 is constituted by a single member having a substantially fan shape and rotates at a rotation angle equal to the rotation angle of the actuator 91. Therefore, when the actuator 91 is rotated until it becomes substantially horizontal, the detection piece 93 shields the optical path of a detection sensor 94 and is brought into contact with a ceiling 97.

In contrast, in the sheet detection device 10 of this embodiment, when the actuator 20 swings around the rotary shaft 30 located at the same height as the rotary shaft 92 in the conventional example and takes the open posture, the first detection piece 40 and the second detection piece 50 can correspond to the movable area of the actuator 20 as described above. As a result, the ceiling 154 with which the upper edge 56 of the second detection piece 50 is brought into contact has a height difference h with respect to the ceiling 97 in the conventional example. In other words, in the sheet detection device 10 of this embodiment, the height of the ceiling 154 can be lowered as compared with the conventional example, and even if the ceiling 154 is provided lower in this way, a sufficient movable area of the actuator 20 can be secured. Therefore, a space can be saved in the paper discharge device 15 in which the sheet detection device 10 is provided and the image forming apparatus 1, and size reduction of the apparatus can be realized.

In the above-described embodiment, the case in which the sheet detection device 10 is provided in the paper discharge device 15 in the image forming apparatus 1 is described, but the present invention is not limited thereto, and the sheet detection device 10 may be provided in a post-treatment device, not shown, including a function of bundling and binding a plurality of image formed sheets and the like and a paper feeding device, not shown, such as a manual feed tray for supplying mainly irregular-sized sheets.

The image forming apparatus 1 including the sheet detection device 10 as above may be a monochrome image forming apparatus or a color image forming apparatus (a tandem type color image forming apparatus, for example). The image forming apparatus 1 may be a multifunction machine having a copy function, a printer function, a scanner function, and a facsimile function, and the like.

Since the above-mentioned description of the embodiment describes preferred embodiments in the image forming apparatus of the present invention, various technically preferable limitations may be given, but the technical scope of the present invention is not limited to these aspects unless otherwise described to limit the present invention. In other words, the constituent elements in the above-described embodiment of the present invention can be replaced with existing constituent elements and the like as appropriate, and various variations are possible, including combinations with other existing constituent elements, and the description in the above-described embodiment does not limit the contents of the invention described in claims.

What is claimed is:

1. A sheet detection device comprising:

an actuator that is swingably in contact with a sheet;

a rotary shaft that supports the actuator and rotates with the actuator;

a detection piece that is supported by the rotary shaft and is rotatable therewith; and a detection sensor a detection area of which overlaps a rotation trajectory of the detection piece, wherein the detection piece includes a first detection piece integrally provided on the rotary shaft and a second detection piece attached to the first detection piece via a biasing member, the second detection piece is rotatable in conjunction with the first detection piece under a biasing force of the biasing member, when the second detection piece is brought into contact with a ceiling disposed at an upper part of the rotary shaft, the second detection piece stops further rotation, while the first detection piece is rotatable together with the rotary shaft against the biasing force, the first detection piece and the second detection piece are provided to face each other in an axial direction of the rotary shaft, and the first detection piece is provided within a projected area of the second detection piece in the axial direction.

2. The sheet detection device according to claim 1, wherein the second detection piece is provided to be rotatable with respect to the rotary shaft, and the biasing member biases the second detection piece, with respect to the first detection piece, upward in a direction of rotation around the rotary shaft.

3. The sheet detection device according to claim 1, wherein the second detection piece includes a shield that shields or opens an optical path formed in the detection area of the detection sensor, and the shield has a substantially arcuate shape around the rotary shaft.

4. The sheet detection device according to claim 1, wherein the second detection piece includes a spacer protrusion that maintains a constant distance from the first detection piece.

5. A paper discharge device including the sheet detection device according to claim 1, wherein the actuator is brought into contact with a sheet passing through a sheet discharge port and swings between a standby posture crossing the sheet discharge port and an open posture opening the sheet discharge port, a paper discharge tray, in which the sheet having passed through the sheet discharge port is loaded, is provided below the actuator, and in the standby posture, a tip of the actuator is brought into contact with an uppermost sheet on the paper discharge tray.

6. An image forming apparatus comprising the paper discharge device according to claim 5.

7. An image forming apparatus comprising the sheet detection device according to claim 1.

8. A sheet detection device comprising:

an actuator that is swingably in contact with a sheet;

a rotary shaft that supports the actuator and rotates with the actuator;

a detection piece that is supported by the rotary shaft and is rotatable therewith; and a detection sensor a detection area of which overlaps a rotation trajectory of the detection piece, wherein the detection piece includes a first detection piece integrally provided on the rotary shaft and a second detection piece attached to the first detection piece via a biasing member, the second detection piece is rotatable in conjunction with the first detection piece under a biasing force of the biasing member, when the second detection piece is brought into contact with a ceiling disposed at an upper part of the rotary shaft, the second detection piece stops further rotation, while the first detection piece is rotatable together with the rotary shaft against the biasing force, the first detection piece has a guide protrusion protruding toward the second detection piece, and the second detection piece has a substantially arcuate guide groove around the rotary shaft, and the guide protrusion can slide in the guide groove.

9. A sheet detection device comprising:

an actuator that is swingably in contact with a sheet;

a rotary shaft that supports the actuator and rotates with the actuator;

a detection piece that is supported by the rotary shaft and is rotatable therewith; and a detection sensor a detection area of which overlaps a rotation trajectory of the detection piece, wherein the detection piece includes a first detection piece integrally provided on the rotary shaft and a second detection piece attached to the first detection piece via a biasing member, the second detection piece is rotatable in conjunction with the first detection piece under a biasing force of the biasing member, when the second detection piece is brought into contact with a ceiling disposed at an upper part of the rotary shaft, the second detection piece stops further rotation, while the first detection piece is rotatable together with the rotary shaft against the biasing force, the second detection piece is provided to be rotatable with respect to the rotary shaft, the biasing member biases the second detection piece, with respect to the first detection piece, upward in a direction of rotation around the rotary shaft, and the biasing member is a kick spring having a coil externally attached to the rotary shaft and a locking portion extending from the coil and locked by the first detection piece and the second detection piece, respectively, and is disposed in a contracted state.

* * * * *